US011268354B2

(12) United States Patent
Older et al.

(10) Patent No.: US 11,268,354 B2
(45) Date of Patent: Mar. 8, 2022

(54) METHOD AND APPARATUS FOR TEMPORARY INJECTION USING A DYNAMICALLY POSITIONED VESSEL

(71) Applicant: Trendsetter Engineering, Inc., Houston, TX (US)

(72) Inventors: David Older, Houston, TX (US); James V. Maher, Houston, TX (US); Patrick Michael Cargol, The Woodlands, TX (US)

(73) Assignee: TRENDSETTER ENGINEERING, INC.

( * ) Notice: Subject to any disclaimer, the term of this patent is extended or adjusted under 35 U.S.C. 154(b) by 0 days.

(21) Appl. No.: 17/352,182

(22) Filed: Jun. 18, 2021

(65) Prior Publication Data

US 2021/0396100 A1 Dec. 23, 2021

Related U.S. Application Data

(60) Provisional application No. 63/040,728, filed on Jun. 18, 2020, provisional application No. 63/040,736, filed on Jun. 18, 2020, provisional application No. 63/040,739, filed on Jun. 18, 2020.

(51) Int. Cl.

| | |
|---|---|
| ***E21B 17/01*** | (2006.01) |
| ***E21B 17/20*** | (2006.01) |
| ***E21B 33/038*** | (2006.01) |
| ***E21B 34/04*** | (2006.01) |
| ***E21B 43/013*** | (2006.01) |
| ***E21B 43/16*** | (2006.01) |
| ***E21B 47/06*** | (2012.01) |
| ***E21B 47/07*** | (2012.01) |

(52) U.S. Cl.

CPC ..... *E21B 43/013* (2013.01); *E21B 17/01* (2013.01); *E21B 17/20* (2013.01); *E21B 33/038* (2013.01); *E21B 34/04* (2013.01); *E21B 43/16* (2013.01); *E21B 47/06* (2013.01); *E21B 47/07* (2020.05); *E21B 2200/20* (2020.05)

(58) Field of Classification Search

CPC ..... E21B 17/01; E21B 17/20; E21B 33/038; E21B 34/04; E21B 43/013; E21B 43/16; E21B 47/06; E21B 47/07; E21B 2200/20

See application file for complete search history.

(56) References Cited

U.S. PATENT DOCUMENTS 4,730,677 A * 3/1988 Pearce ..... E21B 17/015 166/345
5,615,977 A 4/1997 Moses et al.
7,040,408 B2 * 5/2006 Sundararajan ..... E21B 33/0415 166/368

(Continued)

*Primary Examiner* — Matthew R Buck

(74) *Attorney, Agent, or Firm* — Jonathan Pierce; Pierre Campanac; Porter Hedges LLP

(57) ABSTRACT

A dynamically positioned vessel (DPV) is located above an injection well, inject water or other fluids temporarily or for a short period of time, adjust the injection parameters, and either continue operating for the life of the system or as long as required to add permanent facilities on another platform. The DPV is connected to the potential injection well via a hybrid riser system. The hybrid riser system includes a rigid portion and a flexible portion. Injection using the DPV and the hybrid rise system can be more economical than injection using a conventional mobile offshore drilling unit (MODU) and a rigid riser.

20 Claims, 3 Drawing Sheets

(56) References Cited

U.S. PATENT DOCUMENTS

| | | | | |
|---|---|---|---|---|
| 8,297,359 | B2 * | 10/2012 | McKay | E21B 33/076 166/359 |
| 9,797,223 | B1 * | 10/2017 | Gordon | E21B 37/10 |
| 11,060,380 | B2 * | 7/2021 | Wells | E21B 19/24 |
| 2010/0294505 | A1 | 11/2010 | Sbordone et al. | |
| 2013/0299179 | A1 | 11/2013 | Joensen et al. | |
| 2017/0211355 | A1 | 7/2017 | Maher | |
| 2018/0058165 | A1 * | 3/2018 | Maher | E21B 34/04 |
| 2018/0058166 | A1 * | 3/2018 | Maher | E21B 47/06 |
| 2021/0189827 | A1 * | 6/2021 | Kvarme | E21B 17/015 |

* cited by examiner

METHOD AND APPARATUS FOR TEMPORARY INJECTION USING A DYNAMICALLY POSITIONED VESSEL

CROSS-REFERENCE TO RELATED APPLICATIONS

This application claims the benefit of priority to U.S. provisional application Ser. No. 63/040,728 filed on Jun. 18, 2020, which is incorporated herein by reference for all and/or any purposes.

BACKGROUND

This disclosure relates generally to a method and apparatus for injection using a dynamically positioned vessel (DPV). This disclosure relates more particularly to a method and apparatus for temporary, optionally, short-term injection into a subsea well.

The offshore Oil & Gas industry has developed subsea wells to produce oil and gas from reservoirs below the ocean or lake. Under normal conditions, the wells produce the hydrocarbons naturally due to reservoir pressure, gas cap expansion, water aquifer support, or other naturally occurring drive mechanisms. In a number of subsea reservoirs, these naturally occurring drive mechanisms need artificial drive mechanisms to increase the production rate of hydrocarbons or recover the ultimate amount of hydrocarbons after years of production (or both). The industry has used Enhanced Oil Recovery (EOR) projects to address these reservoir challenges. EOR projects are reservoir-specific and may contain a combination of gas injection wells and water injection wells. Unfortunately, EOR projects are expensive due to the subsea wells, subsea infrastructure, and the topside injection infrastructure (pumps, chemicals, etc.) required.

The effectiveness of the EOR projects is highly dependent on the reservoir characteristics, including the type of reservoir fluids and the fracture gradient, permeability, and stratigraphy of the hydrocarbon-bearing formations. Oil & Gas operators use advanced reservoir models to compute the effectiveness of an EOR project and plan the location of the injection and production wells. Sometimes, these reservoir models have considerable uncertainty. In certain cases, these wells are located in incorrect or underperforming locations, and the topside injection equipment is incorrectly specified, all based upon the reservoir analysis. Identical water or gas injection mechanical systems can have widely divergent effectiveness as driven by the reservoir response.

Ultimately, the production capacity of reservoirs can only be proven via real-world experience. Temporary injection tests have been performed before but have been performed from mobile offshore drilling units (MODUs) because a riser is required to connect the topside injection equipment to the subsea well. These tests have also typically been limited to short durations due to the cost of the MODUs. Indeed, the risers typically used are rigid in nature and require a derrick or specialized handling system to prevent damage to the subsea well. The specialized handling systems that are required limit the technically available fleet of vessels. These riser handling systems incite the Oil & Gas operators to use a MODU or other expensive vessel that is fitted with a derrick/tower system.

Therefore, there is a need in the art for a method and apparatus for injection into a subsea well that do not require a MODU. Preferably, the method and apparatus are well suited for temporary or short-term injection.

BRIEF SUMMARY OF THE DISCLOSURE

The disclosure describes a method for injecting fluid into a subsea well in which a Xmas-tree is coupled to a subsea wellhead that is located at the top of the subsea well.

The method may comprise the step of providing a dynamically positioned vessel (DPV) that includes a hoist. The hoist may include a crane, a winch, a davit, a block and tackle, or another known hoisting mechanism. The DPV may include one or more injection pumps.

The method may comprise the step of assembling a system. The system may comprise a lower riser package (LRP) that includes a bore closable with a seal capable of emergency shut down and emergency disconnect sequence. The bore of the LRP may be connectable, directly or indirectly, to the subsea wellhead. The system may comprise an emergency disconnect package (EDP) that includes a bore connected to the bore of the LRP, the bore of the EDP being closable with a fail-safe close valve. The system may comprise a tapered stress joint (TSJ) that includes a bore connected to the bore of the EDP. The system may comprise a flexible riser portion that includes a bore connected to the bore of the TSJ. The system may comprise a rigid riser portion that is connected to the flexible riser portion.

In some embodiments, the method may comprise the step of lowering the system from the hoist of the DPV onto the top of the Xmas-tree.

In some embodiments, the method may comprise the step of lowering the system from the hoist of the DPV onto the top of a subsea pile that is provided on a seafloor. The LRP may be coupled to the subsea pile.

The method may comprise the step of connecting the bore of the LRP to a bore of the Xmas-tree.

The method may comprise the step of injecting fluid at least through the system, through the Xmas-tree, and into the subsea well. Injecting the fluid may be performed using the one or more injection pumps.

The method may comprise the step of adjusting at least one of injection pressure and injection flow rate.

The method may comprise the step of measuring a reservoir response to the at least one adjusted injection pressure and injection flow rate.

The method may comprise the step of updating a reservoir model based on the measured reservoir response.

The method may comprise the step of disconnecting the system from the Xmas-tree.

In some embodiments, the method may comprise the step of connecting the system to a flow base coupled to the subsea pile. The flow base may include a flowline closable with shut-down valves and a high integrity pressure protection systems (HIPPS). The HIPPS may include a sensor of wellbore pressure or temperature, and logic electronics that is communicatively coupled to the sensor and programmed to close the shut-down valves based on measurements performed by the sensor.

In some embodiments, the method may comprise the step of assembling another system. The other system may comprise a lower riser package (LRP) that includes a bore closable with a seal capable of emergency shut down and emergency disconnect sequence. The other system may comprise an emergency disconnect package (EDP) that includes a bore connected to the bore of the LRP, the bore of the EDP being closable with a fail-safe close valve. The other system may comprise a tapered stress joint (TSJ) that includes a bore connected to the bore of the EDP. The other system may comprise a flexible riser portion that includes a bore connected to the bore of the TSJ. The other system may comprise a rigid riser portion that is connected to the flexible riser portion. The other system may be lowered from the hoist of the DPV onto the top of a subsea pile that is provided on a seafloor. The LRP of the other system may be coupled to the subsea pile. The bore of the LRP of the other system may be connected to the bore of the Xmas-tree through a jumper.

In some embodiments, the top of the Xmas-tree may further be connected to a second riser and a topside assembly capable of pumping fluid through the second riser, through the Xmas-tree, and into the subsea well. At least a portion of the topside assembly may be repaired or replaced while injecting fluid through the system. Alternatively, injecting the fluid through the system may be performed while pumping fluid through the second riser, through the Xmas-tree, and into the subsea well. At least a portion of the topside assembly may be replaced with components designed based on the measured reservoir response.

The disclosure also describes an apparatus for injecting fluid into a subsea well.

The apparatus may comprise an assembly that includes the LRP, the EDP, the TSJ, and the rigid riser portion that is connected to the flexible riser portion, The apparatus may comprise the DPV.

The apparatus may comprise the surface tree. The surface tree may be positioned on the DPV. The one or more injection pumps may be connected to the rigid riser portion via the surface tree.

The apparatus may comprise the Xmas-tree that is provided on a seafloor.

In some embodiments, the bore of the LRP may be connected on top of the Xmas-tree.

In some embodiments, the apparatus may comprise the flow base. The flow base may be mounted on the subsea pile. The bore of the LRP may be connected on top of the flow base.

In some embodiments, the LRP is mounted on the subsea pile, and the bore of the LRP is connected to the subsea wellhead via the jumper.

BRIEF DESCRIPTION OF THE DRAWINGS

For a more detailed description of the embodiments of the disclosure, reference will now be made to the accompanying drawings, wherein.

DETAILED DESCRIPTION OF EMBODIMENTS

Figure 1:
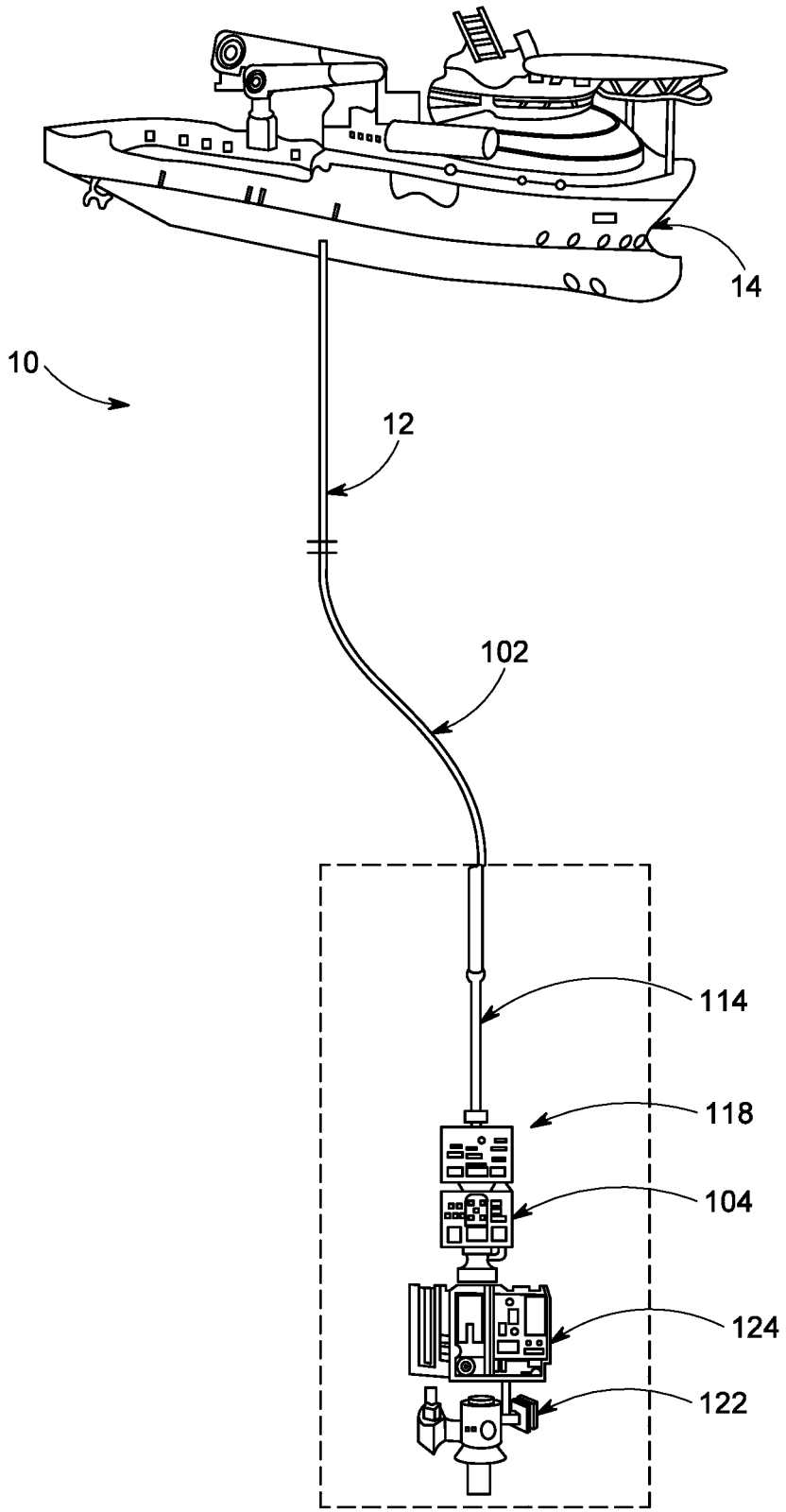
FIG. 1 is a schematic view of an apparatus useable for injection.

It is to be understood that the following description discloses one or more exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

The disclosure describes a method and apparatus to facilitate a short-term or temporary injection program to allow Oil & Gas operators to prove the accuracy of the reservoir models and/or the producibility of reservoirs in actual conditions without investing all the costs to build a long-term EOR project. The method/apparatus involves a DPV that can be located above a potential injection well, inject water or other fluids temporarily or for a short period of time, adjust the injection parameters, and either continue operating for the life of the apparatus or as long as required to add permanent facilities on another platform. The method/apparatus also involves a hybrid riser system to connect the vessel to the subsea well or subsea flowline system. The hybrid riser system includes a rigid portion and a flexible portion. Introducing a flexible portion in the riser system can facilitate injection operations. Indeed, the flexible portion of the riser is used to mitigate fatigue loading and vessel heave. As such, the hybrid riser system does not require a heave compensation system, in contrast to a MODU, which has a heave compensation system. Consequently, injection operations can be performed with a DPV, which are usually more available than MODUs. Also, the cost of deploying a DPV is usually lower than the cost of deploying a MODU.

This method/apparatus would allow the Oil & Gas operators to construct a short-term or temporary injection system to connect to a subsea well and perform injection tests that can confirm or provide better estimates of a number of characteristics of the reservoir models. In turn, these confirmed or improved characteristics of the reservoir models may allow the Oil & Gas operators to better plan the long-term EOR project. In other words, this method/apparatus would allow the Oil & Gas operator to test the efficiency of a planned EOR system before sanctioning a full field EOR project. Secondarily, this method/apparatus may be used to supplement an existing EOR project. For example, this method/apparatus may also be used as a backup to an existing EOR project that may experience a mechanical failure that prevents the permanent equipment from performing as required. Another potential use for this method/apparatus is to allow the adjustment of the injection pressures and/or flowrates (or other injection parameters) to optimize the overall performance of an existing EOR project.

The apparatus can be designed such that short-term operations can be done as cost-effectively as possible but have features that allow the apparatus to be upgraded for longer-term operations. For short-term operations, subsea components similar to the subsea components typically utilized with an intervention riser can enter through the top of a Xmas-tree that is provided on top of the wellhead. For longer-term operations, reliance on the top entry does not provide an optimal level of safety, and additional features may be added to enhance the apparatus's safety. For example, the apparatus can be upgraded by installing a pile separate from the Xmas-tree and subsea components similar to the subsea components typically utilized in early production systems.

FIG. 1 illustrates an apparatus useable for short-term or temporary injection of fluid into a subsea well. The apparatus comprises a dynamically positioned vessel (DPV) 14 that includes a hoist. The hoist may include a crane, a winch, a davit, a block and tackle, or another known hoisting mechanism. For example, the DPV 14 may be a multi-service vessel (MSV). The apparatus also comprises a system 10 that may be transported to the location of a potential injection well disassembled and then assembled on the DPV 14. System 10 is shown fully assembled and suspended from the hoist of the DPV 14 in FIG. 1.

Figure 3:
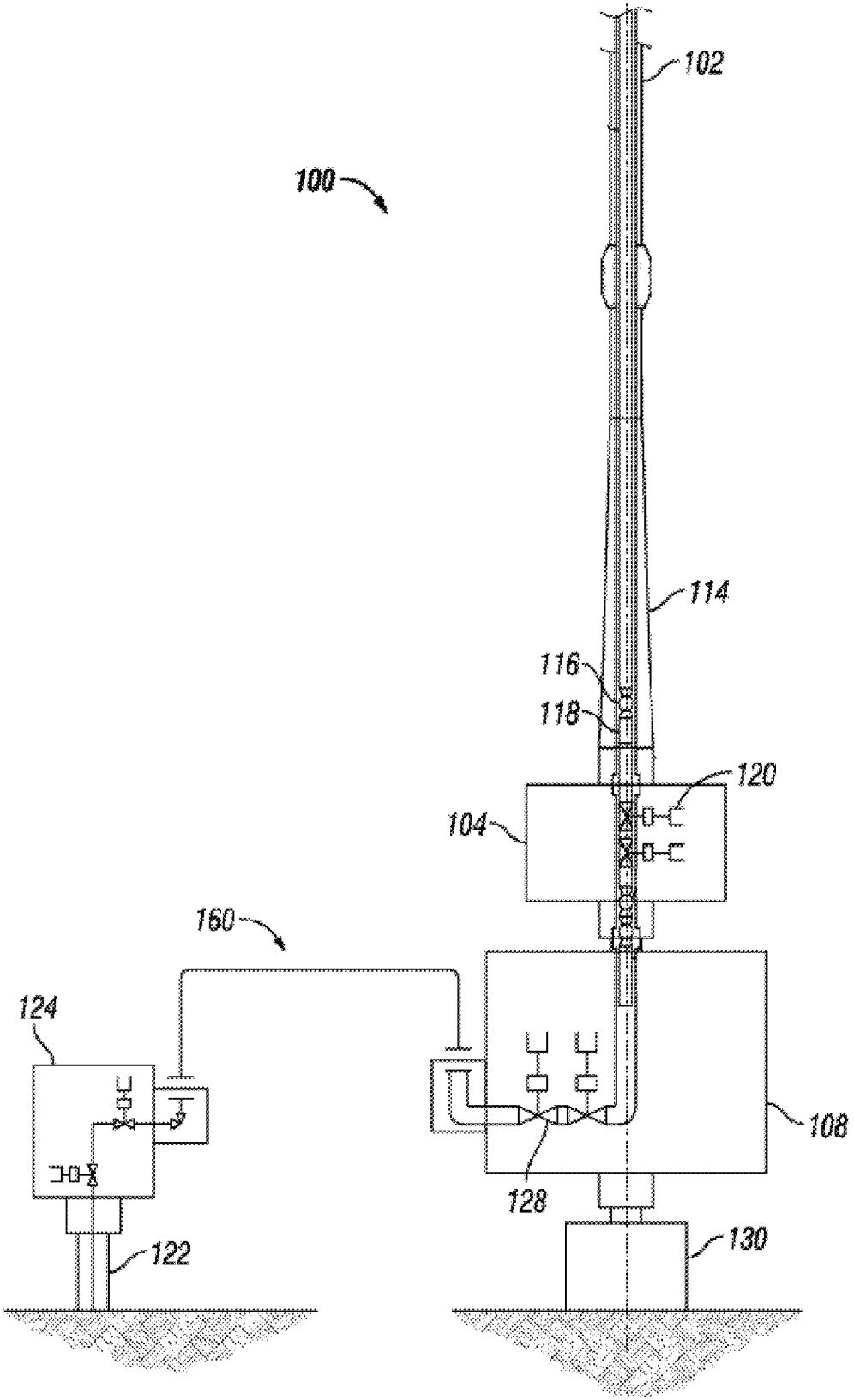
FIG. 3 is a schematic view of a portion of an apparatus useable for injection, the portion being located on the seafloor.

System 10 comprises a lower riser package (LRP) 104. The LRP 104 includes bore isolation valves to shut off and isolate the subsea well during normal operations and during emergency operations. These valves would typically be considered primary well control barriers. The LRP 104 may also include a control panel for a remotely operated vehicle (ROV) to manually operate the valves. Additionally, the LRP 104 may include chemical injection ports to facilitate well operations. As such, the LRP 104 includes a bore closable with a seal and/or a shear ram 120 (shown in FIG. 3) and one or more accumulator supply bottles (not shown) capable of actuating the seal and/or a shear ram 120. Preferably, the seal is capable of completing an emergency shut down and an emergency disconnect sequence. The shear ram is optional and may be useful when tools and wellbore components (e.g., wireline plugs) are deployed in the subsea well. The bore of the LRP 104 is connectable to a subsea wellhead 122 located at the top of the subsea well via one or more components such as a Xmas-tree 124 and optionally a flow base 108 (as shown in FIG. 3). System 10 further comprises an emergency disconnect package (EDP) 118. The EDP 118 includes a bore that is connected to the bore of the LRP 104 when system 10 is assembled. The bore of the EDP 118 is closable with a fail-safe close valve 116 (shown in FIG. 3) and one or more accumulator supply bottles (not shown) capable of actuating the fail-safe close valve 116. System 10 further comprises a tapered stress joint (TSJ) 114. The TSJ 114 includes a bore that is connected to the bore of the EDP 118 when system 10 is assembled. System 10 further comprises a hybrid riser system that includes a flexible riser portion 102 and a rigid riser portion 12. The flexible riser portion 102 includes a bore that is connected to the bore of the TSJ 114 when system 10 is assembled. The rigid riser portion 12 is connected to the flexible riser portion 102 when system 10 is assembled.

In the example of FIG. 1, system 10 is lowered from the hoist of the DPV 14 onto the top of the Xmas-tree 124. The bore of the LRP 104 is connected to a bore of the Xmas-tree 124. However, in other examples, such as shown in FIG. 3, system 10 is lowered from the hoist of the DPV 14 onto the top of a flow base 108 that is connected to the Xmas-tree 124, and the bore of the LRP 104 is connected to a bore of the flow base 108.

Preferably, system 10 has a bore thru the riser system (i.e., the rigid riser portion 12 and the flexible riser portion 102), the TSJ 114, the EDP 118, and the LRP 104 having a diameter sufficient to allow passage of tools and wellbore components (e.g., wireline plugs). The shape of the flexible riser portion 102 can be modified to facilitate the passage of these tools and wellbore components by properly positioning the DPV 14 above the subsea wellhead 122.

The LRP 104 and EDP 118 may be operated from the DPV 14, be automated, or be operated with the ROV.

Figure 2:
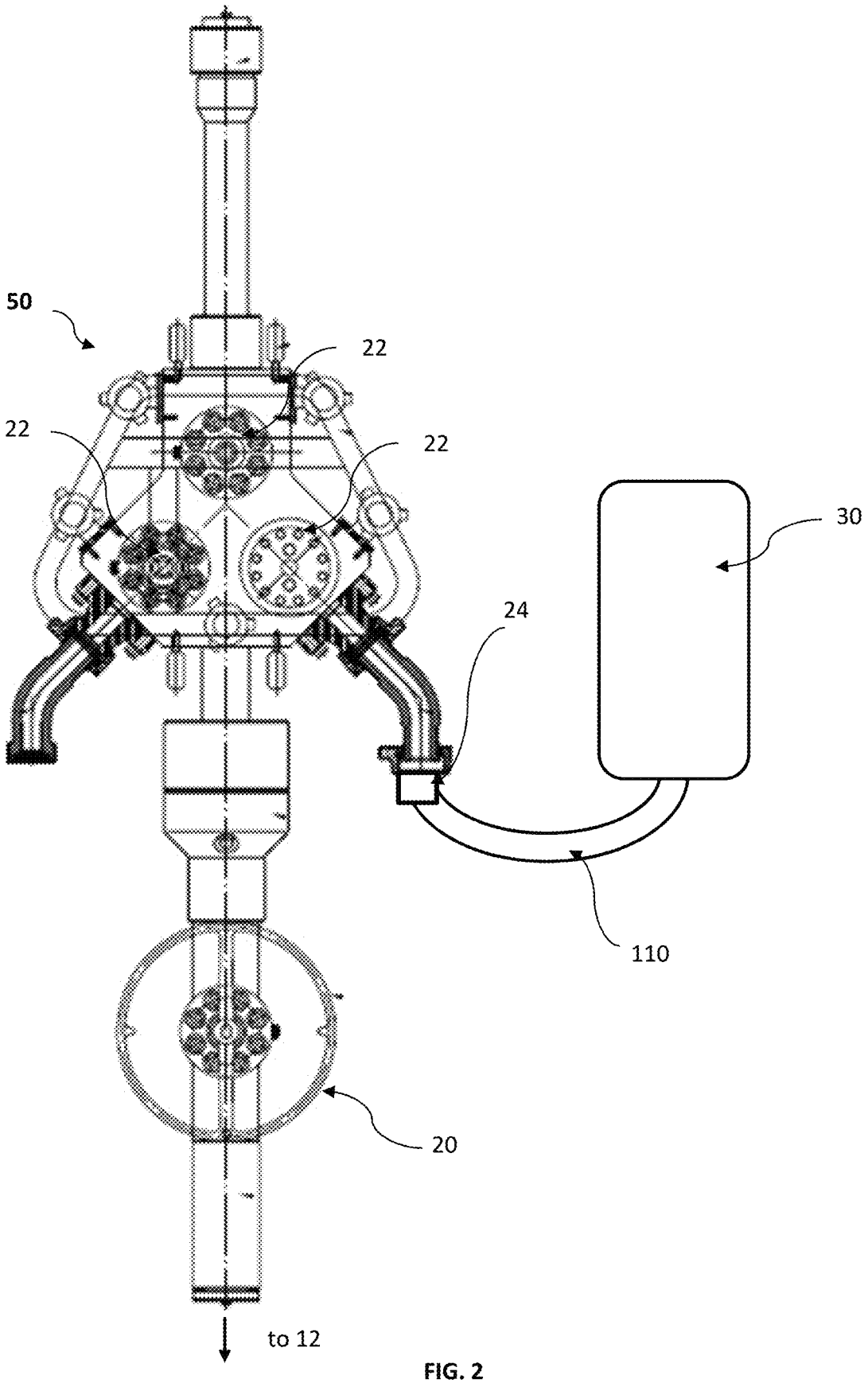
FIG. 2 is a schematic view of a portion of an apparatus useable for injection, the portion being located on a dynamically positioned vessel.

FIG. 2 illustrates a portion of an apparatus useable for short-term or temporary injection. The portion illustrated in FIG. 2 is located on a DPV, for example, the DPV 14 shown in FIG. 1. The apparatus comprises injection pumps 30 and a surface tree (or surface flow head) 50 that are used to perform the fluid injection. The injection pumps 30 are used to inject fluid, typically water or gas, through system 10, through the Xmas-tree 124, and into the subsea well shown in FIG. 1. The surface tree 50 connects the injection pumps 30 to the rigid riser portion 12, the flexible riser portion 102, and the TSJ 114 via a flexible hose 110.

The surface tree 50 further includes one or more valves 22 capable of sealing off the rigid riser portion 12. The surface tree 50 also includes a pressure and/or flow rate sensor 24 capable of measuring pressure and/or flow rate of the fluid flowing into (or out of) the flexible hose 110, the rigid riser portion 12, the flexible riser portion 102, and the TSJ 114. As shown in FIG. 2, one of the valves 22 controls the flow out of the injection pumps 30 and the flexible conduit 110, and the pressure and/or flow rate sensor 24 can measure injection pressure and/or injection flow rate. The surface tree 50 further includes a main valve 20 that may be used in emergency situations.

The injection pumps 30 are preferably capable of adjusting injection pressure and/or injection flow rate. As such, a reservoir response to the injection pressure or injection flow rate can be measured. For example, the reservoir response can be characterized by parameters such as injection flow rate (measured by the sensor 24) when the injection pressure is adjusted, injection pressure (measured by sensor 24) when the injection pressure is adjusted, hydrocarbon production flow rate out of another well, water production flow rate out of another well, pressure in another well, or other reservoir parameters. A reservoir model can be updated based on the measured reservoir response. The updated reservoir model can be used to design the equipment for a long-term EOR project.

In other embodiments, the injection pumps 30 may be included on a vessel other than the DPV 14.

FIG. 3 illustrates a portion of an apparatus useable for short-term or temporary injection. The portion illustrated in FIG. 3 is located on the seafloor. In the example of FIG. 3, a lower portion 100 of system 10 is lowered from the hoist of a DPV, for example, the DPV 14 shown in FIG. 1, onto the top of a flow base 108 that is connected to the Xmas-tree 124 via a jumper 160, and the bore of the LRP 104 is connected to a bore of the flow base 108. For the sake of clarity, the rigid riser portion 12, the DPV 14, the surface tree 50, and the injection pumps 30 are not shown in FIG. 3.

The flow base 108 is coupled to a subsea pile 130 that is anchored into the seafloor near the subsea wellhead 122. The flow base 108 includes a flowline closable with one or more shut-down valves of high integrity pressure protection systems (HIPPS) 128. The HIPPS 128 also includes one or more sensors of wellbore pressure or temperature (not shown), one or more accumulator supply bottles (not shown) capable of actuating the shut-down valves, and logic electronics (not shown) that is communicatively coupled to the sensor and programmed to close the shut-down valves based on measurements performed by the sensor. Compared to FIG. 1, the apparatus comprises the HIPPS 128, which enhances the apparatus's safety, for example, for longer-term injection operations. Indeed, the HIPPS 128 can be used to protect the LRP 104, the EDP 118, the TSJ 114, and the hybrid riser system that includes the flexible riser portion 102 and the rigid riser portion 12 from high pressures that may arise from the subsea well. In particular, the HIPPS 128 allows the use of an LRP, EDP, TSJ, and hybrid riser system rated at a lower pressure than required in the absence of the HIPPS 128.

The injection pumps 30 (in FIG. 2) are used to inject fluid, typically water or gas, through the system 10, the flow base 108, through the jumper 160 connecting the flow base 108 to the Xmas-tree 124, through the Xmas-tree 124, and into the subsea well.

In some embodiments, the apparatus useable for short-term or temporary injection can be initially assembled without the flow base 108, as shown in FIG. 1, and then upgraded as shown in FIG. 3. For example, the subsea pile 130 and the flow base 108 can be installed while fluid is injected into the subsea well, as shown in FIG. 1. Then, system 10 can be disconnected from the top of the Xmas-tree 124 and reconnected to the subsea well by connecting the bore of the LRP 104 to the flowline of the flow base 108.

In other embodiments, the apparatus useable for short-term or temporary injection can be initially assembled with the flow base 108, as shown in FIG. 3.

Optionally, a top of the Xmas-tree 124 is further connected to a second riser (not shown) and a topside assembly (not shown) capable of pumping fluid through the second riser, through the Xmas-tree 124, and into the subsea well. In some cases, the apparatus can be used to replace the injection normally occurring through the second riser while the topside assembly coupled to the second riser (not shown) is being repaired or replaced by another topside assembly. In other cases, the apparatus can be used to supplement the injection normally occurring through the second riser. In such cases, the apparatus may provide enhanced operational flexibility for adjusting injection pressure and/or injection flow rate into the subsea well. As such, a reservoir response to the adjusted injection pressure or injection flow rate can be measured, and a reservoir model can be updated based on the measured reservoir response. The updated reservoir model can be used to redesign the equipment for a long-term EOR project, for example, redesign the topside assembly coupled to the second riser.

While the LRP 104, the EDP 118, and the HIPPS 128 have been described as being actuated by accumulator supply bottles, other actuators known in the art can be used instead of, or in addition to, accumulator supply bottles.

In alternative embodiments to the one shown in FIG. 3, the flow base 108, including the HIPPS 128, may be omitted. As such, the LRP 104 would be configured to be coupled to the subsea pile 130 and to a jumper 160.

Regardless of whether the flow base 108 is provided or not, coupling the LRP 104 directly or indirectly to a subsea pile 130 avoids transmitting loads to the wellhead 122. These loads may be caused by vibrations of the LRP 104, the EDP 118, the TSJ 114, the flexible riser portion 102, and the rigid riser portion 12, or by the movement of the DPV 14. Compared to FIG. 1, coupling the LRP 104 directly or indirectly to a subsea pile 130 enhances the apparatus's safety, for example, for longer-term injection operations.

What is claimed is:

1. A method for injecting fluid into a subsea well, wherein a Xmas-tree is coupled to a subsea wellhead located at the top of the subsea well, the method comprising:

providing a dynamically positioned vessel (DPV) including a hoist;

assembling a system comprising:

a lower riser package (LRP) including a bore closable with a seal capable of emergency shut down and emergency disconnect sequence;

an emergency disconnect package (EDP) including a bore connected to the bore of the LRP, the bore of the EDP being closable with a fail-safe close valve;

a tapered stress joint (TSJ) including a bore connected to the bore of the EDP;

a flexible riser portion including a bore connected to the bore of the TSJ; and a rigid riser portion connected to the flexible riser portion;

lowering the system from the hoist of the DPV onto the top of the Xmas-tree;

connecting the bore of the LRP to a bore of the Xmas-tree; and injecting fluid through the system, through the Xmas-tree, and into the subsea well.

2. The method of claim 1, wherein the DPV further includes one or more injection pumps; and wherein injecting the fluid is performed using the one or more injection pumps.

3. The method of claim 1, further comprising:

disconnecting the system from the Xmas-tree; and connecting the system to a flow base coupled to a subsea pile, the flow base including a flowline closable with shut-down valves and a high integrity pressure protection systems (HIPPS), the HIPPS including a sensor of wellbore pressure or temperature, and logic electronics that is communicatively coupled to the sensor and programmed to close the shut-down valves based on measurements performed by the sensor;

wherein the fluid is injected through the system, through the flow base, through a jumper connecting the flow base to the Xmas-tree, through the Xmas-tree, and into the subsea well.

4. The method of claim 1, further comprising:

disconnecting the system from the Xmas-tree;

assembling another system comprising:

a lower riser package (LRP) including a bore closable with a seal capable of emergency shut down and emergency disconnect sequence;

an emergency disconnect package (EDP) including a bore connected to the bore of the LRP, the bore of the EDP being closable with a fail-safe close valve;

a tapered stress joint (TSJ) including a bore connected to the bore of the EDP;

a flexible riser portion including a bore connected to the bore of the TSJ; and a rigid riser portion connected to the flexible riser portion;

lowering the other system from the hoist of the DPV onto the top of a subsea pile provided on a seafloor;

coupling the LRP of the other system to the subsea pile; and connecting the bore of the LRP of the other system to the bore of the Xmas-tree through a jumper;

wherein the fluid is injected through the other system, through the jumper, through the Xmas-tree, and into the subsea well.

5. The method of claim 1, further comprising:

adjusting at least one of injection pressure and injection flow rate;

measuring a reservoir response to the at least one adjusted injection pressure and injection flow rate; and updating a reservoir model based on the measured reservoir response.

6. A method for injecting fluid into a subsea well, wherein a Xmas-tree is coupled to a subsea wellhead located at the top of the subsea well, the method comprising:

providing a dynamically positioned vessel (DPV) including a hoist;

assembling a system comprising:

a lower riser package (LRP) including a bore closable with a seal capable of emergency shut down and emergency disconnect sequence;

an emergency disconnect package (EDP) including a bore connected to the bore of the LRP, the bore of the EDP being closable with a fail-safe close valve;

a tapered stress joint (TSJ) including a bore connected to the bore of the EDP;

a flexible riser portion including a bore connected to the bore of the TSJ; and a rigid riser portion connected to the flexible riser portion;

lowering the system from the hoist of the DPV onto the top of a subsea pile provided on a seafloor;

coupling the LRP to the subsea pile;

injecting fluid through the system, through a jumper connecting the LRP to the Xmas-tree, through the Xmas-tree, and into the subsea well.

7. The method of claim 6, wherein the DPV further includes one or more injection pumps; and wherein injecting fluid into the subsea well is performed using the one or more injection pumps.

8. The method of claim 6, wherein the system is lowered from the hoist of the DPV onto the top of a flow base coupled to the subsea pile, the flow base including a flowline closable with shut-down valves and a high integrity pressure protection systems (HIPPS), the HIPPS including a sensor of wellbore pressure or temperature, and logic electronics that is communicatively coupled to the sensor and programmed to close the shut-down valves based on measurements performed by the sensor, wherein the flow base is connected to the Xmas-tree via the jumper, the method further comprising connecting the bore of the LRP to the flowline of the flow base.

9. The method of claim 6, wherein the top of the Xmas-tree is further connected to a second riser and a topside assembly capable of pumping fluid through the second riser, through the Xmas-tree, and into the subsea well.

10. The method of claim 9, further comprising:

repairing or replacing at least a portion of the topside assembly while injecting fluid through the system.

11. The method of claim 9, wherein injecting the fluid through the system is performed while pumping fluid through the second riser, through the Xmas-tree, and into the subsea well.

12. The method of claim 11, further comprising:

adjusting at least one of injection pressure and injection flow rate into the subsea well measuring a reservoir response to the at least one adjusted injection pressure and injection flow rate.

13. The method of claim 12, further comprising:

replacing at least a portion of the topside assembly with components designed based on the measured reservoir response.

14. An apparatus for injecting fluid into a subsea well, comprising:

an assembly, wherein the assembly includes:

a lower riser package (LRP) including a bore closable with a seal capable of emergency shut down and emergency disconnect sequence;

an emergency disconnect package (EDP) including a bore connected to the bore of the LRP, the bore of the EDP being closable with a fail-safe close valve and one or more accumulator supply bottles capable of actuating the fail-safe close valve;

a tapered stress joint (TSJ) including a bore connected to the bore of the EDP;

a flexible riser portion including a bore connected to the bore of the TSJ; and a rigid riser portion connected to the flexible riser portion, wherein the bore of the LRP is connectable to a subsea wellhead located at the top of the subsea well; and an injection pump transportable on a dynamically positioned vessel (DPV), wherein the assembly is connectable to the injection pump.

15. The apparatus of claim 14, further comprising the DPV, the DPV including a hoist, wherein the assembly is suspended from the hoist.

16. The apparatus of claim 15, further comprising a surface tree, wherein the injection pump is connected to the rigid riser portion via the surface tree.

17. The apparatus of claim 16, wherein the surface tree and the injection pump are positioned on the DPV.

18. The apparatus of claim 14, further comprising a Xmas-tree provided on a seafloor, wherein the bore of the LRP is connected on top of the Xmas-tree.

19. The apparatus of claim 14, further comprising a flow base mounted on a subsea pile provided on a seafloor, the flow base including a flowline closable with shut-down valves and a high integrity pressure protection systems (HIPPS), the HIPPS including a sensor of wellbore pressure or temperature, and logic electronics that is communicatively coupled to the sensor and programmed to close the shut-down valves based on measurements performed by the sensor, wherein the bore of the LRP is connected on top of the flow base.

20. The apparatus of claim 14, wherein the LRP is mounted on a subsea pile provided on a seafloor, and wherein the bore of the LRP is connected to the subsea wellhead located at the top of the subsea well via a jumper.

* * * * *